United States Patent [19]

Daly

[11] 4,411,074

[45] Oct. 25, 1983

[54] PROCESS AND APPARATUS FOR THERMALLY DRYING OIL WELL CUTTINGS

[76] Inventor: Charles L. Daly, 205 Baker St., Broussard, La. 70518

[21] Appl. No.: 299,543

[22] Filed: Sep. 4, 1981

[51] Int. Cl.[3] ..... F26B 3/04

[52] U.S. Cl. ..... 34/32; 34/33; 34/131; 34/137; 175/207; 175/66; 208/186; 422/900; 432/106; 432/108

[58] Field of Search ..... 34/131, 135, 136, 137, 34/32, 33, 132; 175/206, 207, 66; 134/19; 201/7, 8, 10, 35; 202/105, 136; 208/184, 186; 422/309, 900; 432/106, 108; 198/631; 406/47

[56] References Cited

U.S. PATENT DOCUMENTS

| | | | |
|---|---|---|---|
| 2,850,809 | 9/1958 | Lamb | 34/135 |
| 3,850,477 | 11/1974 | Aldrich et al. | 406/47 |
| 4,119,193 | 10/1978 | Smith et al. | 198/631 |
| 4,139,462 | 2/1979 | Sample, Jr. | 175/66 |
| 4,193,208 | 3/1980 | Ronning | 34/131 |
| 4,262,429 | 4/1981 | Auril | 34/128 |
| 4,280,879 | 7/1981 | Tacluk | 202/136 |
| 4,285,773 | 8/1981 | Taciuk | 202/136 |

*Primary Examiner*—Larry I. Schwartz
*Attorney, Agent, or Firm*—Thomas S. Keaty

[57] ABSTRACT

The present invention relates to a process and apparatus for drying oil well cuttings. More particularly, the present invention relates to the direct thermal treatment of oil well drill cuttings whereby the cuttings will be freed from any excess liquid and removed for storage or disposal on site or bagging.

12 Claims, 4 Drawing Figures

PROCESS AND APPARATUS FOR THERMALLY DRYING OIL WELL CUTTINGS

GENERAL BACKGROUND

During the rotary drilling operation, a rotary drill bit would be inserted into the formations within the earth to provide a well bore. This bore would eventually lead to the sedimentary formations which may contain oil or natural gas. The drill bore would then be cased within metal sheathing, with large pipes or the like, and the cuttings would be removed from the hole and carried up by use of various weights of drilling mud. The drilling mud utilized in this process would be processed out of the bore where it would be distributed across various shale shakers, desanders and desilters and other piees of equipment for further processing in order to help eliminate unfavorable impurities in the drilling mud. During the drilling process, the cuttings which are brought up from the bore, are usually saturated with water and following their passage through a shale shaker which utilizes a certain size mesh screen, this drilling mud would then flow to desanders and desilters which would help to remove the impurities from the drilling mud.

Following the removal of the impurities from the drilling mud, the mud then would be recirculated back into the hole in order to help remove the cuttings from the drill bit during the drilling process, and to help reduce the possibility of a blow-out occurring by providing weight above any potential oil or gas bearing formations. In the present state of the art, the cuttings which have been passed through various stages are discharged into normally a drilling reserve pit on land and off-shore would normally be discharged into the water or in some instances, onto a barge for transport to a land disposal area. On barge locations, cuttings would be stored for transportation to a land area disposal site where they can be disposed of under certain guidelines. When the cuttings are brought to the surface with the drilling mud, the drilling mud and the cuttings would absorb a substantial amount of moisture and/or oil.

The most troublesome problems which arise are areas where the drilling operations take place on land, and there is sufficient population for creating a health hazard and a potential risk for unauthorized personnel to wander on to the location area. The clean up of these locations becomes a very serious problem during and after the drilling operation, and oil companies undergo normally tremendous expense in these operations. The excess cuttings, often times must be hauled off by large trucks which is a very expensive process, and alternative methods are required in order to reduce the cost and time involved in the disposal of these cuttings. Likewise, on off-shore operations, the drill cuttings, ifthey contain a portion of oil, cannot be dumped into the water around the rig, thus must be hauled off to land where they may be disposed of in storage pits and likewise, alternative methods of disposal would be necessary in order to cut the cost and the time involved.

Several patents speak to the treatment of cuttings and/or drilling mud from drill holes, and these, for the most part, are as follows:

U.S. Pat. No. 3,693,951 issued to Lawhon et al entitled "Process and Apparatus for the Treatment of Well Cuttings" which teach the use of a heating chamber having a conveyor to take drilling mud through the chamber for treatment. Essentially, a pre-heater for partial drying in a high intensity heater for the complete drying of the cuttings is provided. Also, there is a disclosure of the process for treating by a pair of heating steps, including conveying the cuttings to a combustion chamber and resolving the cuttings while intermediate of the combustion chamber for later discharge.

U.S. Pat. No. 3,293,768 issued to A. D. Blank et al entitled "Treating Fluidized Material" would teach the use of an apparatus which would utilize up-flowing gas and down-flowing gas to centrally dry material that is being conveyed through the apparatus. The solid material would move along a continuous belt, with gas flowing upward to support and lift and fluidize material in the stream of gas and would have a down-flowing stream of air for in turn, redepositing the material on the bed with a kind of tumbling of the material within the fluidized chamber as it is dried.

U.S. Pat. No. 2,678,504 issued to W. A. Knopp, entitled "Apparatus for Drying Cut Staples" is adapted for fiber drying in a mat or blanket type conveyor belt which passes through a heated chamber.

U.S. Pat. No. 4,139,462 issued to Sample, Jr. entitled "Method for Thermally Treating Oil Well Cuttings" would teach the use of drying drill cuttings by utilizing continuous process employing the principal of stream stripping distillation to affect the simultaneous removal of hydrocarbons and water from the cuttings, leaving them in a condition sufficiently pollution free as to be fit for direct disposal in waters adjacent to the off-shore drilling platform. The cuttings would pass through the heated vessel at about 500° to 700° F. for a period of 5–15 minutes and then would be discharged from the bottom of the vessel. During the process, it must be oxygen free so that the ignition of the cuttings does not occur.

U.S. Pat. No. 3,713,499 issued to Arscott et al entitled "Method and Apparatus for Treating Drilling Mud," and U.S. Pat. No. 3,777,405 issued to Crawford entitled "Drilling Mud Reclaiming Apparatus" are also several patents which teach methods of drying and treating drill mud.

GENERAL BACKGROUND OF THE PRESENT INVENTION

The present invention would solve the problems encountered in the present state of the art of drying oil well cuttings in a simple and inexpensive straightforward manner. The present invention would provide an apparatus and a process for treatment of oil well cuttings for substantially decreasing the volume of water and oil in the cuttings and storing the cuttings following the drying process. Essentially, following the passage of the cutting through desilters, desanders and shale shakers, cuttings would be deposited directly into a holding tank for transport of the cuttings out of the holding tank and into the drying apparatus itself. The cuttings would be transported, with the help of air pressure, or with the assistance of a vacuum for disallowing blockage of the transport line. The cuttings would then be transported into the cylindrical drying chamber apparatus, which would be supported by rollers for rotation during the drying process. A plurality of vanes or the like would be positioned longitudinally along the interior wall of the chamber, with the vanes having a concave upper surface for retaining the cuttings to a certain point during the rotation of the apparatus and thus dropping the cuttings during the drying process.

At the end distal to the feeding of the wet cuttings into the chamber, a burner would emit sufficient quantities of superheated air in addition to the burner flames into the chamber for complete thermal aeration of the cuttings as they are turbulated within the chamber via rotation of the chamber and carrying of the cuttings with the concave vane network. In order to assure that the cuttings are moved along the length of the chamber, the entire chamber would have the ability to be angulated at various positions downward to regulate the speed of the cuttings as they move through the chamber. Following the movement of the cuttings at the end distal to the entrance end of the chamber, the cuttings would be removed onto a conveyor belt for conveying into a receiving tank or the like.

Also is provided a means to exhaust air from the chamber that has been circulated through the cuttings. Preferably, this superheated air would be exhausted from the proximal end of the apparatus with the exhaust feeding into preferably a cyclonic separator wherein the particles or other debris which may be carried out with the super-heated air and deposited into the conveyor belt for conveying along with the cuttings into a receiving tank or the like. The exhaust air could be recirculated back into the apparatus for providing additional quantities of heated air or simply allowed to escape to the atmosphere.

Therefore, it is an object of the present invention to provide a process for drying oil well cuttings with the use of a direct thermal aeration process.

It is still a further object of the present invention to provide an apparatus which allows for continuous tumbling of the cuttings during a direct thermal aeration process.

It is yet another object of the present invention to provide an apparatus for movement of the dried cuttings within the drying chamber at variable rates by elevation of one end of the apparatus, thus regulating the speed of the product therethrough.

It is a further object of the process and appartus of the present invention to provide a complete system for inserting undried cuttings into a thermal aeration chamber, and drying the cuttings while simultaneously providing for collection of exhaust waste which could be harmful to the environment.

It is a feature of the apparatus of the present invention to fulfill the desired object by providing a chamber tank rotatably mounted for continuous rotation during the drying process.

It is an additional feature of the apparatus and process of the present invention to provide a burner preferably located at the distal end of the apparatus for forcing super-heated air and flames into the thermal chamber while the cuttings are being tumbled therethrough.

It is still an additional feature of the apparatus to provide a means for rejoining the cuttings from the cyclonic separator onto the conveyor belt for storage and/or disposal.

It is an additional feature of the apparatus of the present invention to provide a conveyor system for those cuttings which would allow for the movement of the cuttings at various rates depending on the elevation of the apparatus during the process.

BRIEF DESCRIPTION OF THE DRAWINGS

For a further understanding of the nature and object of the present invention, reference should be had to the following detailed description, taken in conjunction with the accompanying drawings in which like parts are given like reference numerals and, wherein.

DETAILED DESCRIPTION OF THE PREFERRED EMBODIMENT

Figure 1:
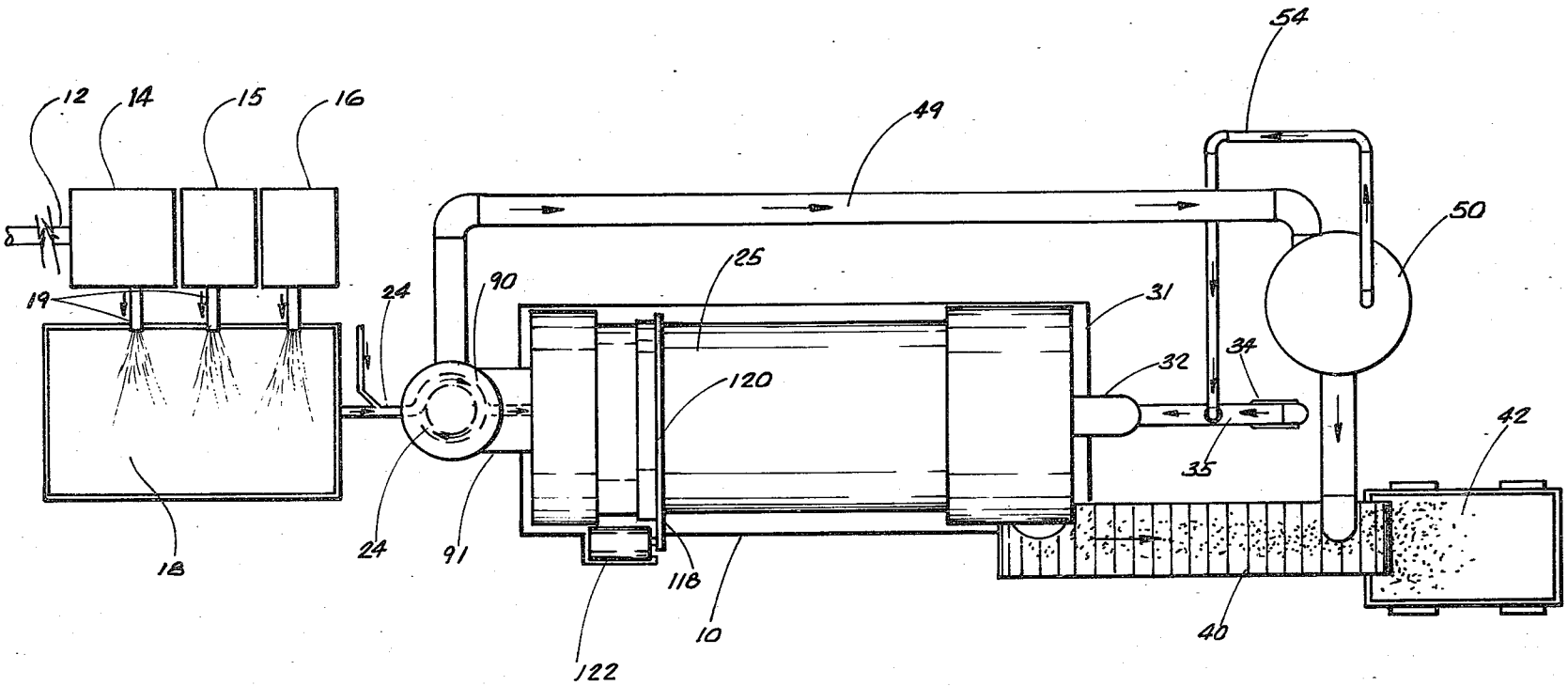
FIG. 1 is a top view of the apparatus involved in the process of the preferred embodiment of the present invention.
Figure 2:
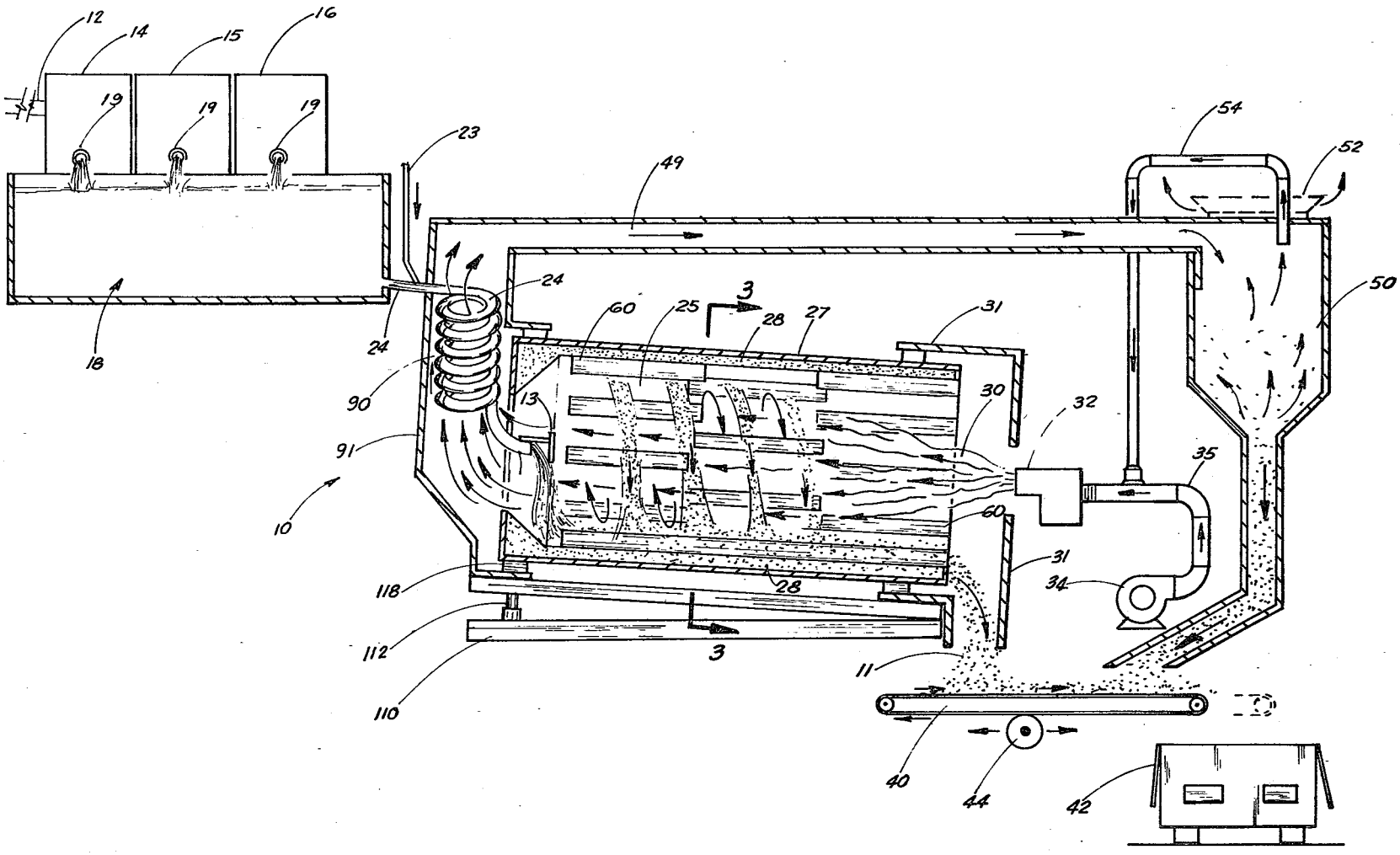
FIG. 2 is a side, partial cut-away view of the apparatus of the preferred embodiment of the present invention.

FIGS. 1 and 2 illustrate in top and partial cut-away views the preferred embodiment of the apparatus involved in the entire process of the present invention. In FIG. 1 there can be seen in top view, an overall view of the movement of the undried mud and cuttings after it has been processed through the well bore. In FIG. 1 there is illustrated flow line 12, which carries mud into, in combination, a desilter apparatus 14, a desander apparatus 15, and a shale shaker apparatus 16. In the preferred embodiment, these three apparatuses are well known in the art, and serve to separate the mud into its components for further use. In our particular apparatus, the mud, following the desilting, desanding and shale shaking process, would be deposited into retainer tank 18 through lines 19 for further movement in the process. As is further illustrated in FIG. 2, retaining tank 18 would be a typical retaining tank for maintaining the wet solids as received from the desilter 14, desander 15 and shale shaker 16. The retaining tank would simply have an opening at its bottom for movement of the solids from the retaining tank into a flow line 24 for movement into the thermal heating apparatus itself. Upon entry of the solids into the flow line 24, which flow line would, in the preferred embodiment, be either air fed or vacuum assisted by pressurized air fed into line 24 via line 23, would carry the solid materials into heating chamber 25 as seen in FIG. 1. In the preferred embodiment, due to the fact that the materials in flow line 24 are somewhat liquid laden, flow line 24, is seen illustrated as spiralling its way through exhaust tower 90 of apparatus 10. This passage of flow line 24 through exhaust tower 90 would allow for initial heating of the materials as they move into heating chamber 25. This heat exchange area would accommodate the initial expulsion into the chamber from flow line 24, the cuttings would be preheated and would be more amenable to the drying process.

FIG. 2 further illustrates the insertion of wet mud into heating chamber 25 of the apparatus as designated by Numeral 10. In FIG. 2 there can be seen in partial cut-away, side schematic view, the insertion of a wet mud 11 into the heating chamber 25 of the apparatus as designated by the Numeral 10. The heating chamber 25 would be provided with a source of hot air 30 from burner 32, with burner 32 receiving a source of fuel for ignition within burner 32 and a source of air blown across the heating element of the burner 32 from blower 34 for forcably feeding heated air 30 into the chamber 25. Also illustrated in FIGS. 1 and 2 is the movement of the dried mud 11 following its passage through chamber 25 wherein the dried mud is deposited onto a conveyor system 40, which would then convey the mud into tank 42 for later storage or bagging. In the preferred embodiment, the conveyor system 40 would be metallic or the like so that the substantially hot solids would not tend to damage a non-metallic conveyor belt during the process. Also, conveyor 40 has the ability to be laterally moved by roller 44 so that the mud is deposited throughout tank 42. Further provided in cut-away view in FIG. 2 is the movement of the forced air out of chamber 25 into exhaust area 90, that same exhaust area which serves as a heat exchange for the mud entering the chamber as previously described, for feeding into exhaust line 49 leading into cyclonic separator 50 wherein the particles of solids would be separated from the exhaust air in the cyclonic separator 50 and would be deposited out of cyclone separator 50 onto conveyor system 40 for conveying, along with the solids obtained out of the chamber 25 into a holding or storage tank 42.

In order to carry out the complete process as is illustrated, FIG. 1, FIGS. 2, 3, and 4 illustrate the preferred embodiments of the apparatus of the present invention involved in the process.

In FIG. 2 there is illustrated in side cut-away view, the retainer tank portion 18 of apparatus 10 in the preferred embodiment. As is illustrated, retainer tank 18 is substantially a four-sided tank having an opened top end and a bottom portion of said tank which could be V-shaped in other embodiments, so that the contents of the tank would tend to settle into the bottom. As is illustrated in FIG. 2, located at the lower-most point of the bottom portion of tank 18 would be flow line 24 extending between tank 18 and the wall of exhaust tower 90 for movement of wet solids from tank 18 into flow line 24. Therefore, upon depositing of the solids into the tank 18, the solids would move towards the bottom of the tank 18 and would be removed from the bottom portion of the tank 18 via line 24. As is further illustrated in FIG. 2, flow line 24 would feed the mud into dryer chamber apparatus 25. At the point of entrance from the flow line 24 into the dryer chamber apparatus, air line 23 would feed into the line 24 for feeding pressurized air into line 24 to assist in moving the material through the line as it went through its spiral pass through the exhaust area of chamber 25.

In the preferred embodiment, the entrance of the mud into the line for feeding into the drying chamber 25 could, as is illustrated, be air assisted via air line 23, or could be vacuum assisted on its furthermost end for movement through the line, thus eliminating the possibility of blockage in the line.

In FIG. 2 there is illustrated heating chamber 25, which is essentially a cylindrically shaped chamber having an outer cylindrical wall portion 27 extending its entire length, with chamber 25 being open ended at both ends. Exterior metal wall 27 would be integrally attached to an inner wall 28, which preferably would be a substantially denser wall constructed of material for resisting the tremendous heat within the drying apparatus, such as fire brick or the like, yet providing continuous internal wall area for the tumbling action of the apparatus to take place.

As is illustrated in FIG. 2, internal wall 28 would, at its proximal end, be somewhat thickened in order to reinforce the entrance end of chamber 25.

Figure 3:
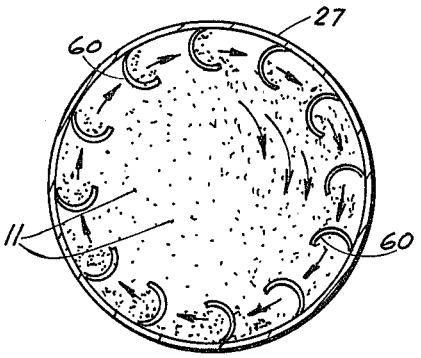
FIG. 3 is a front view taken along lines 2—2 of FIG. 2 of the preferred embodiment of the apparatus of the present invention illustrating the longitudinal vanes within the heating chamber of the apparatus.

As is illustrated in FIG. 2, wet mud would be fed into apparatus 25 via a feed line 24, with the mud being directed downward by frontal plate section 13, so that the mud falls at the very base of chamber 25. Contained within chamber 25 is a plurality of vanes 60, as is illustrated in FIG. 3 in cross-sectional view and FIG. 4. Of course, during this rotation and circulation of the mud 11 would undergo an almost continuous aeration treatment, thus ensuring a complete drying or dehydration of the mud or the cutting during the process.

There is also illustrated in FIG. 2, heat walls 31 which serve to maintain the forced heated air as it is thrusted out of burner 32, assuring that the major portion of the heated air travels through the aeration chamber and is directed through the proximal end of the chamber following the dehydration process. The burner 32, as illustrated in FIG. 2, could be a typical burner of the type which would provide for heating of air travelling therethrough to a temperature sufficient to evaporate all liquids contained in the solids moving through the chamber 25. The burner would be provided with a source of fuel, preferably a fuel source directly from the oil well rig itself, and would be provided with a source of air from blower 34 which would feed the air through the burner thus super-heating the air before feeding it into the aeration chamber via line 35. In the preferred emobidment the thrust of burner 32 would feed flames into the inner space of chamber 25, in addition to super-heated air.

Figure 4:
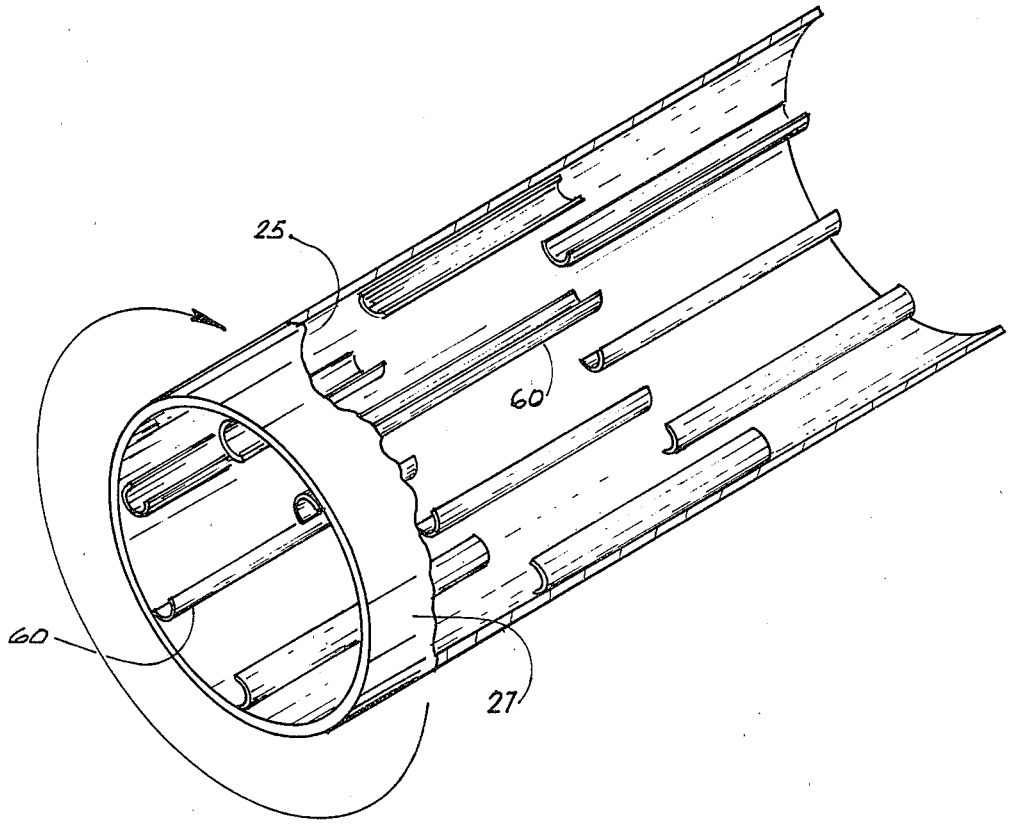
FIG. 4 is an exploded view of the inner vane construction of the preferred embodiment of the apparatus of the present invention.

Contained within chamber 25 is a plurality of vanes 60 as is illustrated in FIG. 3 in cross-section and in FIG. 4 in cut-away perspective view, which serve as a means to evenly distribute the wet mud within the inner space of the chamber 25 during the heating process, while the chamber 25 is being rotated. As can be seen in FIG. 3, vanes 60 would be shaped so that mud 11 could be carried within a concavity of the vanes 60 as the mud is moved around in the rotation process. It should be noted that substantially half of the vanes 60 are concave to a degree so that mud 11 would not be deposited off of the vanes 60 until the vanes 60 have moved through at least more than one half of the rotation of the mud 11 around the interior of the chamber, through the inner-space of the chamber. The second set of vanes 60 would be concave to a point that the mud would be deposited as the mud is being rotated up to the upper most point in the chamber 25 during the rotation process. This particular construction of the vanes 60 will provide the mud be deposited within the chamber 25 heating inner space on both the up swing during the rotation of frontal chamber 25 as the mud is moved up in the rotation and on the down swing during rotation of chamber 25. This is illustrated in FIG. 3 in cross-sectional view.

Of course, during this rotation and circulation of the mud within the chamber, utilizing the concave vanes 60, the mud 11 would undergo an almost continuous aeration and firing treatment, thus ensuring a complete drying or deliquification of the mud or the cuttings during the process.

Following the aeration of the cuttings, the mud being significantly if not completely dried, is moved out of drying 25 for storage. As illustrated in FIG. 2, upon removal of the mud from apparatus 10 through a gravity shoot, the mud 11 would be deposited onto conveyor belt 40, which is essentially constructed of a metallic substance so that the significantly hot mud would not damage rubber or softer material. This conveyor belt would transport the mud into tank 42, as is illustrated in FIG. 2. In the preferred embodiment, the conveyor belt would have the ability to be moved in a lateral direction as the mud is being deposited, so that the mud would be evenly deposited along the complete bottom of the tank, the movement of the belt being illustrated in phantom view in FIG. 2.

Of course, during the entire process, it is essential that the super-heated air 30 which is being forced into the chamber have an exhaust or removal therefrom and accommodating additional air. As is illustrated in FIG. 2, this exhaust system provides an exhaust tower 90 which is preferably located at the entrance end of the apparatus, in view of the fact that the forced air 30 would be travelling in that direction. The exhaust tower 90 would have frontal wall 91 through which the wet mud line 24 would be travelled, so that upon the forced air encountering the wall 91 would then move upward into the exhaust tower 90 for exhaust into the atmosphere. However, due to the fact that the forced air 30 may in fact contain particles of other debris which it may have picked up during the circulation and the turbulance of the drying apparatus, there is provided that the exhaust air is fed through a cyclone separator 50 via exhaust line 49, so that the circulated exhaust air would be exhausted from the top of cyclone separator 50 and the solid or particles contained in the exhaust air would drop to the bottom of the cyclone separator 50 onto conveyor belt 40 for conveying into storage tank 42. The exhaust air which is being exhausted from the cyclone separator 50, could be either exhausted into the air as free air via vent 52 illustrated in phantom view in FIG. 2 or could be recirculated back into the apparatus via line 54 as can be illustrated in FIG. 2, for serving as additional heated air for the drying process. Preferably, this heated air would be routed into line 35 between heater 32 and blower 34 for recycling into the drier apparatus 25. However, the exhaust air could be released into the atmosphere via vent 52, illustrated in phantom in FIG. 2.

As is further illustrated in FIG. 2, drying chamber 25 would be slightly elevated downward from the proximal to the distal end of the apparatus for movement of the mud therethrough. In the preferred embodiment, the drier apparatus would be set upon an elevated skid 110 in order to accommodate the height of the mud shoot for depositing mud onto the conveyer system. This elevated skid 110 would be provided with a means for elevating one end of the proximal end of the drier tank during the drying process. This can be accomplished by a series of hydraulic jacks 112 or the like, so that the elevation of the proximal end of the apparatus could be achieved. It is necessary that this adjustment of the elevation of the apparatus be provided for, to accommodate the speed of the movement of the mud through the apparatus. If, in fact, during the drying process, one finds that the mud is not being properly dried, due to the rapid movement of the mud through the apparatus as the circulation of the mud is accomplished, the proximal end of the apparatus would simply be lowered to a more level degree away from the horizontal so that mud would move substantially slower through the apparatus and thus would be provided with additional heating time during the process. Also, likewise, should the mud be moving too slowly and accumulating in the apparatus, the proximal end could be elevated to an additional height for accellerated movement of the mud through the apparatus as during the circulation aeration and drying process.

As is further illustrated in FIG. 2, the rotation of the apparatus during the drying process would simply be accomplished by a plurality of wheels 118 which are driven by an electric motor 122 or the like (See FIG. 1), which chain drives through a gear attachment wheels would be set in tracks 120 along the exterior of the apparatus, wherefore rotation of the wheels by the motor would impart rotation of the apparatus. The speed of the motor could be adjusted for the adjustment of rotation, and the wheels would be set upon a common axle or the like for even rotation and rotation of the apparatus during the process.

In the preferred embodiment, apparatus 10 would be preferably 40 feet long and 6 feet in diameter and would be constructed of high grade steel, with a means for insulation of the apparatus, with a heat shield or the like on the interior of the apparatus for protection from the immense heat from the blower unit. Also, the apparatus could be set upon the back of a truck or the like for easy movement of the apparatus during the use of the apparatus in the oil field or on the oil rigs or the like.

Because many varying different embodiments may be made within the scope of the inventive concept herein taught and because modifications may be made in the embodiments herein detailed in accordance with the descriptive requirement of the law, it is to be understood that the details hrein are to be interpreted as illustrative and not in a limiting sense.

What is claimed as invention is:

1. A process for thermally aerating oil well drill cuttings to a substantially moisture-free state, comprising the following steps:

a. collecting the cuttings from an oil well bore and storing them in a retainer tank;
b. providing a cylindrical drying chamber with an exit end and an entrance end slightly elevated in relation to the exit end;
c. providing a spiral conduit connecting said retainer tank and said drying chamber;
d. feeding the cuttings into the drying chamber through said spiral conduit;
e. providing a source of pressurized air for assisting the movement of cuttings from said retainer tank down to said drying chamber;
f. providing a source of superheated air;
g. injecting the superheated air into the drying chamber to dry the cuttings;
h. rotating the drying chamber during the injection of the superheated air;
i. providing longitudinal trough-like means within the drying chamber for tumbling the cuttings within the chamber during the rotation of the chamber;
j. removing the dried cuttings from the drying chamber and conveying them into a storage tank.

2. The method of claim 1, wherein said trough-like means for tumbling the cuttings in the heating chamber comprise a plurality of longitudinal lines attached at different angles to the interior wall of the heating chamber.

3. A process for thermally aerating oil well drill cuttings to a substantially moisture-free state, comprising the following steps:

a. receiving the cuttings from the well bore into a feeder line;
b. feeding the cuttings into a retainer tank;
c. transporting the cuttings from said retainer tank;
d. injecting a flow of pressurized air into the transport line for assisting in the transporting of said cuttings from said retainer tank;
e. preheating the cuttings during transportation;
f. feeding the cuttings into a heat chamber;

g. rotating the heating chamber for imparting movement of the cuttings within the chamber;
h. providing longitudinal means for dropping the cuttings through the chamber inner space during rotation of the chamber;
i. injecting super-heated air into the chamber, the thrust of the air being substantially transverse to the movement of the cuttings through the chamber inner space for achieving the drying process;
j. adjusting the elevation of the chamber for regulating movement of the cuttings from an entrance point in the chamber to an exit point in the chamber;
k. removing the substantially dried cuttings from within the chamber;
l. conveying the cuttings into a storage tank.

4. The process in claim 3, wherein the means for dropping of the cuttings through the chamber inner space substantially comprises a plurality of vanes, said vanes having a concave surface for lifting the mud during rotation in the chamber to a predetermined point and redepositing the cuttings onto the floor of the chamber.

5. A method for drying oil well cuttings, comprising the following steps:
a. collecting the oil well cuttings to be dried from the well bore;
b. providing means to store the collected cuttings;
c. providing a substantially cylindrical heating chamber, having an entrance end and an exit end, with a heating inner space therebetween;
d. transporting the cuttings into the drying chamber at the entrance end;
e. providing a burner means for injecting superheated air and flames into the chamber;
f. providing a plurality of longitudinal concave vanes attached at different angles to the inner wall of the chamber;
g. rotating the chamber for conveying the cuttings within the concave vanes to preselected points during the rotation cycle and depositing the cuttings in free fall through the heating chamber inner space;
h. providing means for preheating the cuttings to be dried prior to the cuttings entering the heating chamber;
i. recirculating the exhaust air exiting from the heating chamber back into the burner means;
k. collecting the solids contained in the exhaust air of the heating chamber and redepositing the solids into a storage tank following the drying process.

6. An apparatus for drying oil well cuttings, comprising:
a. a substantially cylindrical heating chamber having an entrance end and an exit end with a heating inner space therebetween;
b. means for rotating the chamber around a longitudinal axis;
c. burner means for injecting heated air into said chamber, said burner means further comprising a blower for conveying air through said burner means and into said chamber;
d. spiral conduit means for conveying the cuttings to be dried into said chamber;
e. a plurality of trough-like vanes longitudinally disposed along the inner wall of said heating chamber for conveying the cuttings to predetermined points during rotation of said heating chamber, and depositing said cuttings in free fall through said burner innerspace;
f. means for positioning said heating chamber off of a horizontal axis, for accelerating or decelerating the movement of the cuttings to be dried from an entrace point to the exit point of said heating chamber;
g. conveyor means for conveying the dried cuttings from the exit point of said heating chamber to a storage tank;
h. a pressurized air flow line connected to said means for conveying the cuttings into said chamber, said air flow assisting in clog-free movement of said cuttings through said spiral conduit means into said chamber.

7. The apparatus in claim 6, wherein said rotation means comprises a plurality of wheels, one of which is power driven for rotating said chamber at a predetermined speed.

8. The apparatus of claim 6, wherein said trough-like vanes are concave at various depths attached at different angles in relation to said inner wall of said chamber for depositing the cuttings to be dried at different points within a rotation cycle.

9. An apparatus for thermally aerating drill cuttings, comprising:
a. a substantially cylindrical heating chamber, having a closed wall exterior, and substantially open-ended on its ends;
b. means for rotation of said chamber at a desired rate;
c. spiral means for injecting cuttings into said chamber during the drying process;
d. means for assisting the movement of the cuttings to be dried into said heating chamber;
e. a plurality of vanes running substantially the length of the interior wall of the chamber, for movement of the cuttings whithin the chamber when the chamber is revolved;
f. an aeration means comprising:
   i. a burner, the face of said burner projecting into said chamber;
   ii. a source of fuel for ignition within the burner;
   iii. a blower means for injecting forced air through the burner for movement into the chamber;
g. exit means for retrieval of the substantially dried cuttings after movement of the cuttings through said chamber;
h. conveyor means for conveying substantially undried dried cuttings into a storage tank;
i. exhaust means for said heating chamber, comprising:
   i. an exhaust tower;
   ii. a spearator means for separating exhaust solids and exhaust gases for subsequent removal therefrom, said solids being routed to said storage tank, and said gases being routed into said heating chamber for reuse.

10. The apparatus in claim 9, further providing means for circulating the wet mud through a heat exchange area in the chamber for preheating the mud, said means substantially comprising a spiral transport line through an exhaust tower of the chamber.

11. The apparatus in claim 9, wherein said plurality of vanes are substantially staggered around the interior wall of the chamber, and are concaved at various depths for even distribution of the mud through the aeration zone.

12. The apparatus in claim 9, wherein said preheating means comprising a flow line conveying mud through a heated exhaust area for preheating the cuttings prior to cuttings entering the drying chamber.

* * * * *